US010383471B1

(12) United States Patent
Barnes et al.

(10) Patent No.: US 10,383,471 B1
(45) Date of Patent: Aug. 20, 2019

(54) PACKAGE PROTECTING DELIVERY RECEPTACLE WITH EXPANDABLE ATTACHMENT BRACKET

(71) Applicant: Pristtine, Inc., Baltimore, MD (US)

(72) Inventors: Lamar Barnes, Washington, DC (US); Jeremeko Watson, Gastonia, NC (US); Rush H. Seale, Silver Spring, MD (US)

(73) Assignee: PRISTTINE, INC., Baltimore, MD (US)

( * ) Notice: Subject to any disclaimer, the term of this patent is extended or adjusted under 35 U.S.C. 154(b) by 0 days.

(21) Appl. No.: 16/050,739

(22) Filed: Jul. 31, 2018

(51) Int. Cl.

| | |
|---|---|
| ***A47G 29/20*** | (2006.01) |
| ***A47G 29/16*** | (2006.01) |
| ***A47G 29/14*** | (2006.01) |
| ***A47G 29/124*** | (2006.01) |
| *G07C 9/00* | (2006.01) |

(52) U.S. Cl.
CPC ..... *A47G 29/20* (2013.01); *A47G 29/124* (2013.01); *A47G 29/141* (2013.01); *A47G 29/16* (2013.01); *A47G 2029/144* (2013.01); *G07C 9/00896* (2013.01)

(58) Field of Classification Search
CPC ..... A47G 29/20; A47G 29/141; A47G 29/16; A47G 29/124; A47G 29/1216; A47G 2029/144; G07C 9/00896; B65D 25/22
USPC ..... 232/19, 27, 39, 1 E; 220/480–482; 70/63
See application file for complete search history.

(56) References Cited

U.S. PATENT DOCUMENTS

| | | | | |
|---|---|---|---|---|
| 1,305,722 | A | 6/1919 | Kees | |
| 1,847,969 | A * | 3/1932 | Marks | A47G 29/20 232/42 |
| 4,694,668 | A | 9/1987 | Ciletti et al. | |
| 4,821,538 | A | 4/1989 | Gray | |
| 4,909,052 | A | 3/1990 | Hutwohl | |
| 5,098,108 | A | 3/1992 | McKinney | |
| 5,150,834 | A | 9/1992 | Bourke | |
| 5,624,071 | A | 4/1997 | Sosan | |
| 5,850,967 | A | 12/1998 | White | |
| 5,979,750 | A | 11/1999 | Kindell | |
| 6,155,715 | A | 12/2000 | Lake et al. | |
| 6,204,763 | B1 * | 3/2001 | Sone | A47G 29/141 221/2 |
| 6,330,816 | B1 * | 12/2001 | O'Connor | E05B 19/0005 109/50 |

(Continued)

FOREIGN PATENT DOCUMENTS

| | | | |
|---|---|---|---|
| EP | 2801302 | A1 | 11/2014 |
| JP | H4_96712 | A | 3/1992 |

(Continued)

*Primary Examiner* — William L Miller
(74) *Attorney, Agent, or Firm* — Bacon & Thomas, PLLC

(57) ABSTRACT

A package-protecting delivery receptacle is attached to a front of the door by a sheet metal belt structure that slidably extends laterally on two sides of the receptacle and around two sides of the door, and in which a clamping mechanism that includes a rotatable clamping knob with a rubber or soft plastic contact surface secures the belt structure to a rear surface of two horizontally-opposed sides of the door. The clamping mechanism is removably attached to the belt structure by a slot and tab, or by a tongue and slider securing arrangement. The belt structure may be made up of two bracket sections that are independently extendable from the two lateral sides of the receptacle.

16 Claims, 10 Drawing Sheets

(56) References Cited

U.S. PATENT DOCUMENTS

| | | | | |
|---|---|---|---|---|
| 6,375,070 | B1 | 4/2002 | Snoke | |
| 6,412,688 | B1 | 7/2002 | Tucker et al. | |
| 6,612,489 | B2 | 9/2003 | McCormick et al. | |
| 6,967,575 | B1 | 11/2005 | Dohrmann et al. | |
| 7,246,738 | B2 | 7/2007 | Jonas | |
| 7,815,112 | B2 | 10/2010 | Volpe et al. | |
| 7,988,035 | B2 | 8/2011 | Cox et al. | |
| 8,358,199 | B2 | 1/2013 | Nesling | |
| 8,371,965 | B2 | 2/2013 | Quinn | |
| 9,596,952 | B2 | 3/2017 | Mencel | |
| 9,700,168 | B1 | 7/2017 | Evans | |
| 9,926,108 | B2 * | 3/2018 | Wiley | B65D 33/00 |
| 2001/0045449 | A1 | 11/2001 | Shannon | |
| 2005/0193931 | A1 | 9/2005 | Boudreau | |
| 2014/0008246 | A1 | 1/2014 | Pfeiffer | |
| 2016/0051073 | A1 | 2/2016 | Heinz et al. | |
| 2016/0068306 | A1 * | 3/2016 | Heinz | B65D 21/086 220/560.01 |
| 2017/0127868 | A1 | 5/2017 | Adewuyi | |
| 2017/0188737 | A1 | 7/2017 | Hippert | |

FOREIGN PATENT DOCUMENTS

| | | | |
|---|---|---|---|
| WO | WO2013049063 | A1 | 4/2013 |
| WO | WO2015177590 | A1 | 11/2015 |
| WO | WO2016131043 | A1 | 8/2016 |

* cited by examiner

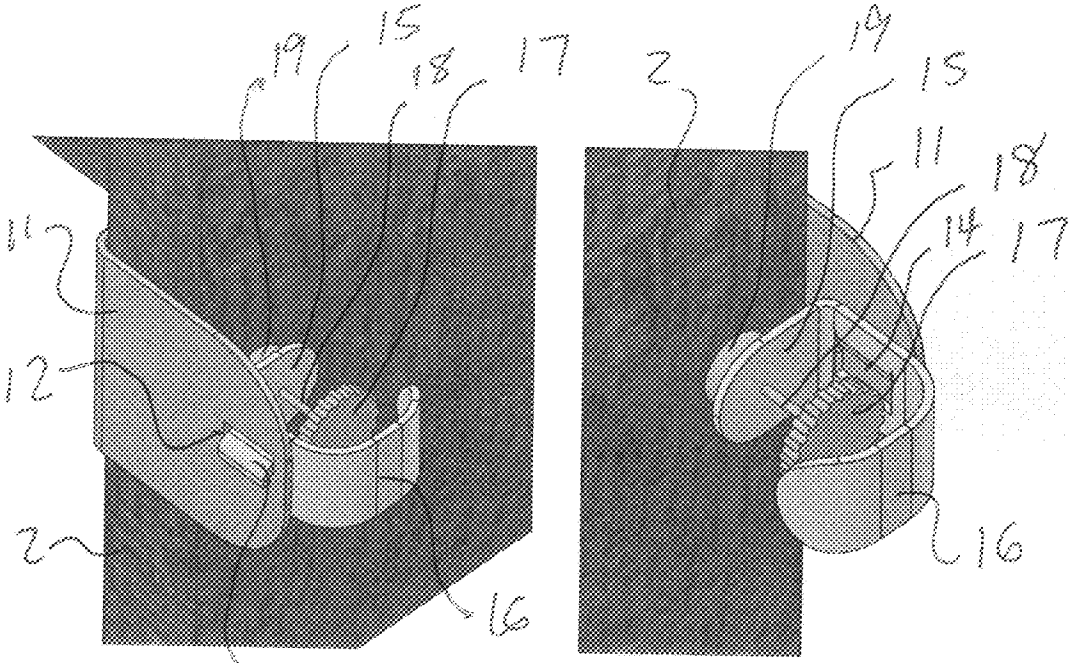
Fig. 5A
Fig. 5B
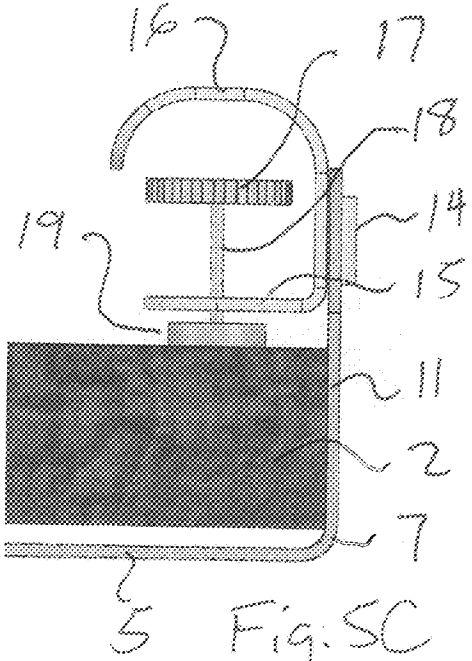
Fig. 5C

PACKAGE PROTECTING DELIVERY RECEPTACLE WITH EXPANDABLE ATTACHMENT BRACKET

BACKGROUND OF THE INVENTION

1. Field of the Invention

The invention relates to a container or receptacle for securely receiving, sending, and protecting package/food deliveries, and in particular to a container or receptacle having an expandable bracket for removably securing the container to the door of a business or residence.

2. Description of Related Art

Online sales offer convenience to the consumer and efficiency for sellers, especially if the purchased product can be delivered rapidly and safely to the consumer's residence or business. This is not always the case, however, since the consumer may not always be present to receive the purchase when it is ready for delivery. Many deliveries are delayed because delivery services are hesitant to deliver to unoccupied buildings. Such delays inconvenience the purchaser and increase costs for the seller. One reason for the hesitance to deliver when no one is available to receive the package include potential for damage to the package due to weather, including spoilage of perishables due to heat. By far the most critical problem is the problem of theft. According to a recent poll, 31% of Americans report having experienced package theft. In 2016 alone, eleven million people had packages stolen from their doorstep. This is the main reason that an estimated one billion packages per year cannot be delivered on the first try because no one is available to receive the packages. One billion packages represents an enormous drag on e-commerce and the economy in general.

One obvious solution, namely allowing the customer to arrange for the package to be left with a neighbor, or having the package delivered to the customer's workplace, entails substantial inconvenience to both the party to whom the package is delivered and the intended recipient, as well as privacy and security concerns, and therefore has not come close to eliminating package theft, or prevented one billion delivery failures.

The problem of package delivery failure or theft has of course not gone unnoticed. To the contrary, online retailers are actively working to solve the problem, recently leading the leading online retailer to launch a program known as Amazon Key™, which involves granting access to vehicles and homes using satellite access, or retrofitting entrances with locking arrangements that permit delivery personnel to actually enter the building to which the package is to be delivered. However, the prospect of entry by a stranger into their vehicle or residence makes many customers uneasy, and the technology has so far not gained widespread acceptance and does not seem to present a widely applicable solution to the problem of package theft or delivery delays or failure when the occupant of the delivery address is absent.

Even though the need for secure package delivery has greatly increased with the popularity of online delivery orders, the problem of package theft actually predates the Internet and online shopping by many years, as have proposals to solve the problem. None has been successful. Packages have been vulnerable to theft and weather from the early days of mail order retailing, which began before the turn of the $20^{th}$ century, as evidenced by the numerous U.S.

patents that have attempted to address the problem. For example, it was proposed in U.S. Pat. No. 1,305,722, which was filed on Nov. 10, 1909, to prevent package theft by fixing a delivery box to a building so that, upon placement of a package therein, the box automatically locked and could only be accessed from inside the building. Since that early proposal, numerous attempts have been made to provide secure receptacles for package deliveries. Examples of patents and patent publications describing proposed solutions to the problem of package delivery protection include those disclosed in U.S. Pat. Nos. 5,150,834; 5,979,750; 6,330,816; 6,375,070; 6,612,489; 6,412,688; 7,246,738; 7,815,112; 7,988,035; 8,358,199; and 9,700,168, U.S. Patent Publication Nos. 2001/0045449; 2005/0193931; and 2014/0008246; International Patent Publication Nos. WO 2013/049063 and WO 2016/131043; and European Patent Publication No. EP 2,801,302.

A disadvantage of most of the previously proposed package theft prevention arrangements, including those disclosed in the above-cited patents and patent publications, is that they require permanent attachment of the delivery receptacle to fixed structures, making installation costly and difficult, and rendering the arrangements unsuitable for use by tenants and lessees of residences and businesses. In addition, since most packages do not fit in mailbox sized containers, the receptacles require a substantial amount of space for installation, and tend to detract from the appearance of the structure or building.

In order to avoid the disadvantages of a permanently attached receptacle, it has also been proposed to make the securing arrangements for the package receptacles temporary or non-permanent, enabling the receptacle to be set out for the purpose of receiving a package, and removed upon removal of the package by the intended recipient. For example, it was proposed in U.S. Pat. Nos. 6,155,755 and 9,596,952, as well as International Patent Publication No. WO 2015/177590 and Japanese Patent Publication No. 4-96712, to enable attachment and removal of a package-receiving receptacle by providing a U-shaped metal bracket designed to utilize the clearance provided under most doors by adapting the bracket to slide under the door when the door was opened, with removal of the bracket and receptacle prevented upon closing the door. Other under-door securing arrangements were disclosed in U.S. Pat. No. 4,821,538 (directed to a shoe rack) and U.S. Patent Publication No. 2017/0188737 (package extension that fits under and engages inside of door only).

While solving some of the problems associated with permanent installations, these under-door receptacle-securing arrangements still have a variety of disadvantages. One disadvantage of the prior under-door bracket arrangements is that most exterior doors have weather-stripping or sweeps that interfere with installation of an under-door bracket. In addition, once the receptacle is installed under the door, it may interfere with opening and closing of the door, necessitating installation only at the time the last occupant of the building who intends to use the door is ready to leave, resulting in a great deal of inconvenience. Furthermore, the bracket itself can cause scratch or damage the door or mar its finish since it is not secured against sliding movement relative to the door as the door is closed and opened, and therefore can scrape against or mar the finish on the door. If the bracket is narrow, any attempt to pull the receptacle away from the door concentrates the pulling force on the area of contact between the bracket and door, increasing the possibility of damage to the door, particular if someone attempts to pull the receptacle away from the door. Still further, the presence of raised thresholds makes it difficult to position the bracket without some sort of flexible tether or pivot to enable the receptacle to rest on the ground despite the bracket resting on the raised threshold under the door.

As an alternative to under-door arrangements, it has also been proposed to secure receptacles to the top of a door. However, such hanging arrangements limit the size of the receptacle that can be used, and because of the difficulty of hanging a solid, heavy receptacle, have tended to involve relatively small receptacles, or bags and soft structures rather than solid boxes, and relatively thin and insecure hooks. Examples of over-door securing arrangements are disclosed in U.S. Pat. Nos. 4,694,668; 4,909,052; and 5,624,017; and U.S. Patent Publication Nos. 2016/0051073 and 2017/0127868.

Finally, another potential solution to the problems of package theft or weather or heat damage to unattended packages or contents of the packages is to simply notify the recipient of an impending package delivery, for example via the Internet as disclosed in U.S. Patent Publication No. 2017/0127868. This solution is necessarily limited as it requires the recipient to be in position to receive the package at the predicted time. Consequently, despite the numerous attempts to solve the problem of protecting delivered packages when the intended recipient is not available, the problem continues to worsen. In view of the importance of package delivery to both vendors and consumers, there is an urgent need for a more secure and yet convenient way to secure and protect delivered packages.

SUMMARY OF THE INVENTION

It is accordingly an objective of the invention to provide a package-protecting delivery receptacle that is easy to install and use.

It is a second objective of the invention to provide a package-protecting delivery receptacle that is easy to install and use, and that can be secured to a door without causing damage to the door.

It is a third objective of the invention to provide a delivery receptacle for packages that is easy to install and used, and that protects packages against theft and bad weather.

One or more of these objectives are achieved, in accordance with principles of a first preferred embodiment of the invention, by a package-protecting delivery receptacle that is attached to a front of the door by a sheet metal belt structure that slidably extends laterally on two sides of the receptacle and around two sides of the door, and in which a clamping mechanism that includes a rotatable clamping knob with a rubber or soft plastic contact surface secures the belt to a rear surface of two horizontally-opposed sides of the door.

Objectives of the invention are also achieved, in accordance with principles of a second preferred embodiment of the invention, by a package-protecting delivery receptacle that is attached to the front of the door by a sheet metal belt structure that slidably extends laterally from two sides of the receptacle and around then the two horizontally-opposed sides of the door, and in which a slidably adjustable clamping mechanism secures the belt to two sides of the door by engaging a rear surface of the door.

Because the invention is secured to the door by a belt-like sheet metal bracket rather than a rigid bracket, which can be passed through the clearance between the door and the door frame on two sides of the door, the invention provides a more secure attachment and yet easily installed attachment, with reduced risk of damage to the door or door frame. The width of the belt distributes forces across a wider area, protecting the door, while the clamping or clamping and sliding mechanisms prevent relative movement between the belt and door, preventing scraping that can damage or mar the door surface. Attachment at the sides of the door also avoids installation problems caused by door sweeps or thresholds.

In addition to the improved receptacle attachment mechanism, which enables simple installation by the customer without damage to or interference with operation to the door (or garage doors) to which the receptacle is attached, the package-protecting receptacle of the invention may include optional additional security and convenience features that allow the delivery carrier to access the receptacle using radio frequency identification (RFID), numeric codes, biometrics, or a variety of other access technologies, as well as notification of delivery to an app on the user's smartphone or personal computing device, a secure, tamper proof metal/industrial fabric case with an angled lid and secure lock, thermal compartments for food deliveries, and customization with respect to size and appearance. Respective to delivery carriers, the invention will enable prospective delivery via remote drones and robots as well as human carriers.

BRIEF DESCRIPTION OF THE DRAWINGS

FIG. 5A is an isometric view showing details of the clamping mechanism for the attachment bracket illustrated in FIGS. 3, 4A, and 4B.

FIG. 5B is a second isometric view of the clamping mechanism of FIG. 5A.

FIG. 5C is a top view of the clamping mechanism of FIGS. 5A and 4B.

DETAILED DESCRIPTION OF THE PREFERRED EMBODIMENTS

Figure 1:
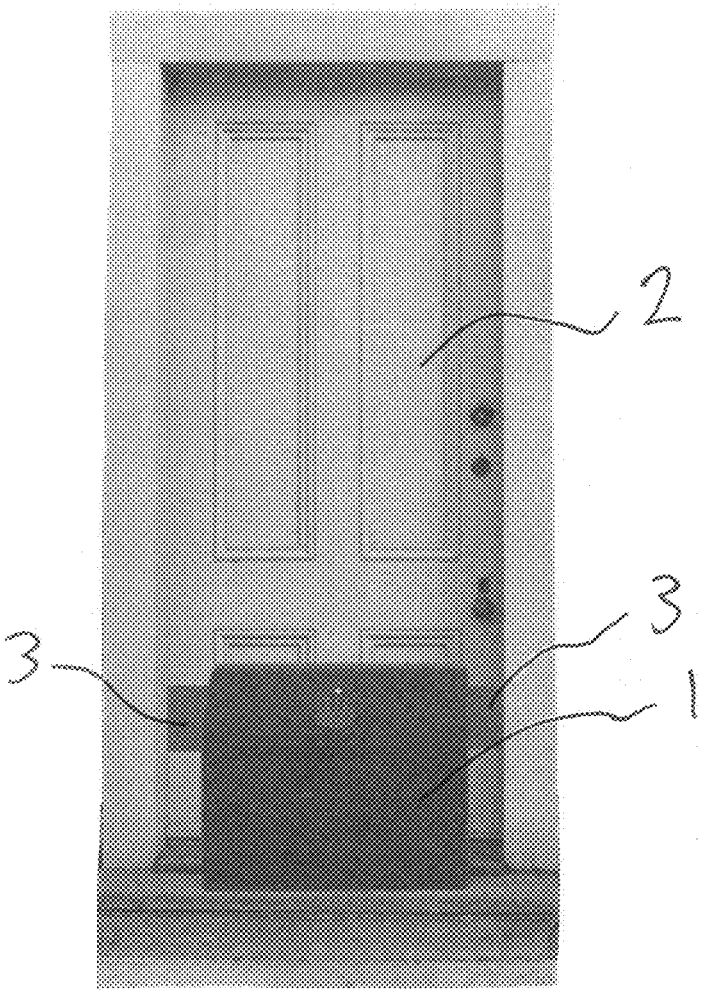
FIG. 1 is a front elevation of a door to which a package-protecting delivery receptacle has been attached in accordance with principles of the invention.

As shown in FIG. 1, a package-protecting delivery receptacle 1 for package deliveries is secured to a door 2 by a belt-like attachment bracket 3 that extends laterally from sides at the rear of the box to horizontally-opposed sides of the door 2. The belt 3 is illustrated herein as a sheet metal structure, but also may be made of a reinforced fabric or similar structure that is resistant to cutting and attempts to pull the receptacle away from the door, and that is thin enough to fit within the clearances at the sides of the door when the door is closed.

As shown in FIGS. 2A-2F, the receptacle 1 is, by way of example and not limitation, a generally parallelepiped-shaped box or container having dimensions sufficient to hold a desired size of package and made of a material having sufficient strength to protect the contents of the box but light enough to enable the customer to carry it to and from the installation position. Suitable materials include metals, industrial fabrics, and plastics. As shown in FIGS. 2A-2F, the container may include a front panel 61, side panels 62, rear panel 63, and a bottom panel 64, although the illustrated shapes and relative dimensions of the respective panels are by way of example only and may be varied without departing from the scope of the invention.

Figure 2A:
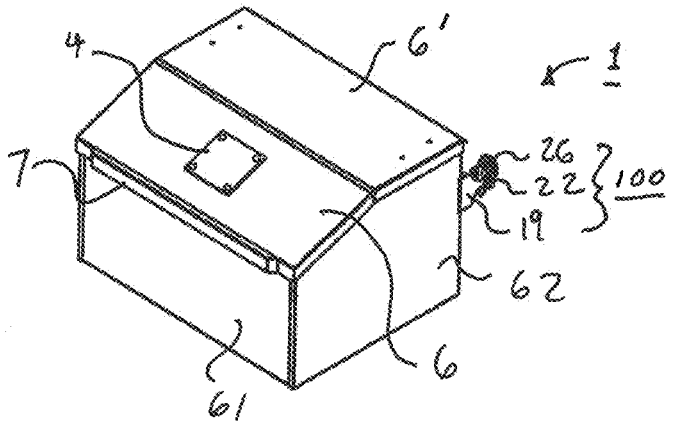
FIG. 2A is an isometric view of the package-protecting delivery receptacle of FIG. 1.
Figure 4A:
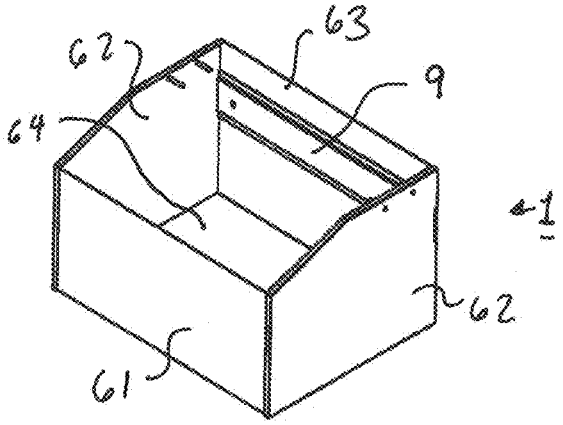
FIG. 4A is an isometric view of the package-protecting delivery receptacle with lid removed.
Figure 4B:
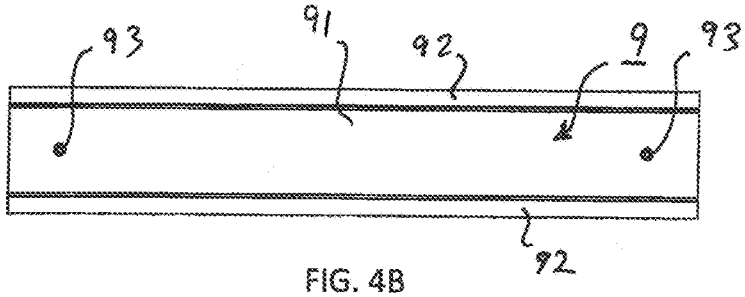
FIG. 4B is a front view of a belt securing plate for the package-protecting delivery receptacle as shown in FIG. 4A.
Figure 4C:
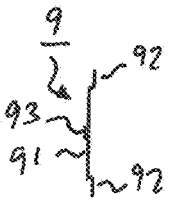
FIG. 4C is a side view of the belt securing plate of FIG. 4B.
Figure 2B:
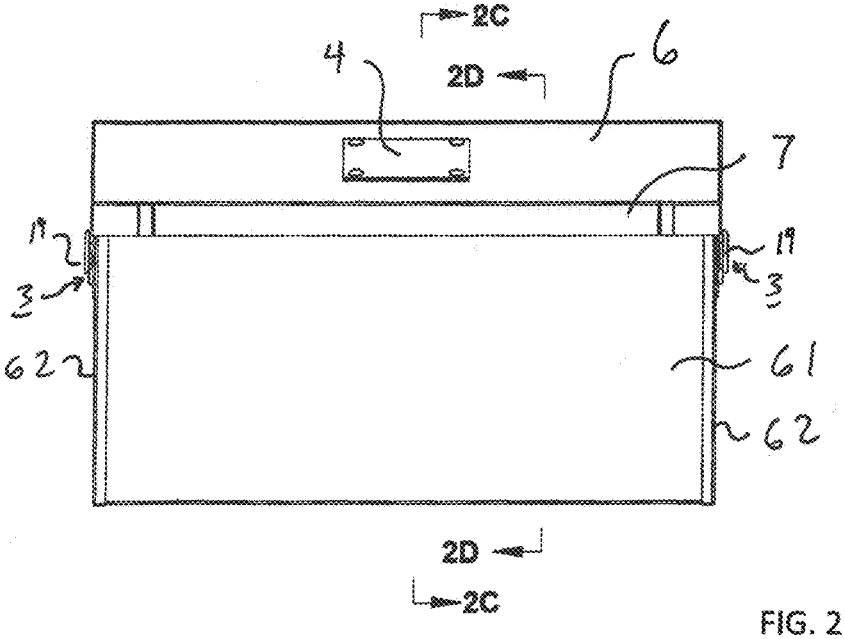
FIG. 2B is a front view of the package-protecting delivery receptacle of FIG. 2A.

As will be described in more detail in connection with FIGS. 3-7, a clamping mechanism, collectively indicated by reference numeral 100, is attached to a bent section 11 of the bracket or belt 3. The clamping mechanism 100 is represented in FIGS. 2A, 2C, 2F, and 2F by elements 20, 22, and 25-27 of a second preferred embodiment of the invention, described in detail below in connection with FIGS. 6 and 7A-7F, but it will be appreciated that other clamping mechanisms may be substituted, including but not limited to the one shown in FIGS. 3 and 5A-5C.

Figure 2C:
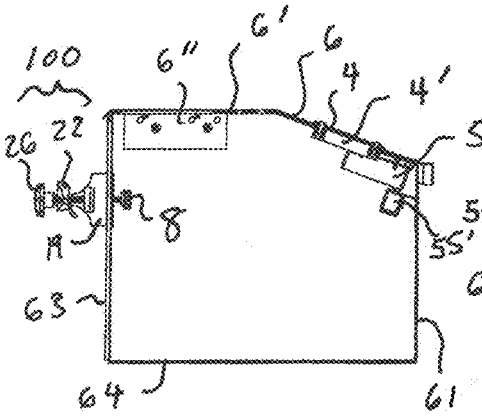
FIG. 2C is a cross-sectional side view taken along line 2C-2C of FIG. 2B.
Figure 2D:
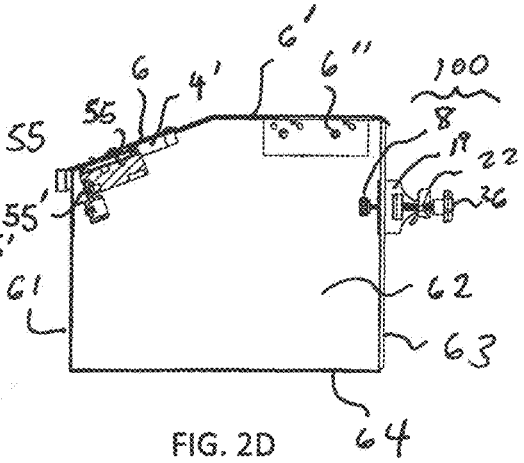
FIG. 2D is a cross-sectional side view taken along line 2D-2D of FIG. 2B.
Figure 2E:
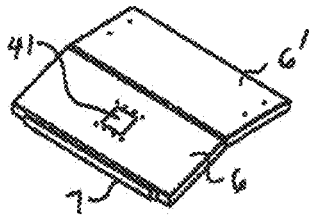
FIG. 2E is an isometric view of a lid and top cover assembly for the package-protecting delivery receptacle of FIG. 2A.

A locking mechanism 55,55' shown in FIG. 2D may be controlled in the illustrated example by an electronic keypad, biometric reader, or other identification input device 4' that is positioned in a waterproof compartment 4' positioned below an opening 41 (shown in FIG. 2E) and cover 4 (shown in FIGS. 2A and 2F) and secured to the lid 6 of the box, as shown in FIG. 2C. The locking mechanism includes a lock/release mechanism 55 controlled by the input device and also secured to the lid 6, and a latch 55' secured to front panel of the container and engageable with the lock/release mechanism (for example a solenoid latch bolt extendable from opening 56 shown in FIG. 2G) to lock the lid when the lid 6 is closed. The lid 6 may be inclined to make it easier to read and manipulate the input device, and may be secured by a hinge (not shown) to a stationary rear cover section 6' fixed to the container by a bracket 6". In addition, the lid 7 may include an optional handle extension or lip 7 that extends from the front of the lid 6, as illustrated in FIGS. 2B-2D and 2F. Still further, the box may optionally be provided with a label (not shown) having one or more carrier names or logos, or other promotional materials.

Figure 2G:
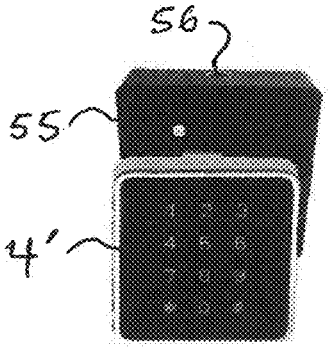
FIG. 2G is an isometric view of a keypad and lock/release mechanism for use in the package-protecting delivery receptacle of FIGS. 2A-2F.
Figure 7D:
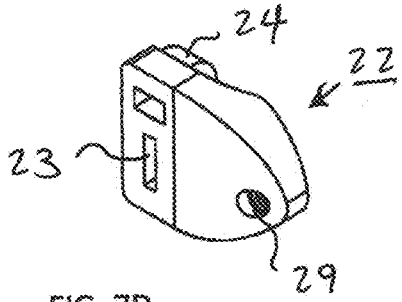
FIG. 7D is an isometric view of a sliding piece used in the clamp and sliding mechanism of FIGS. 7A-7C.
Figure 7E:
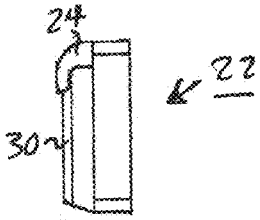
FIG. 7E is a front end view of the sliding piece of FIG. 7D.
Figure 7F:
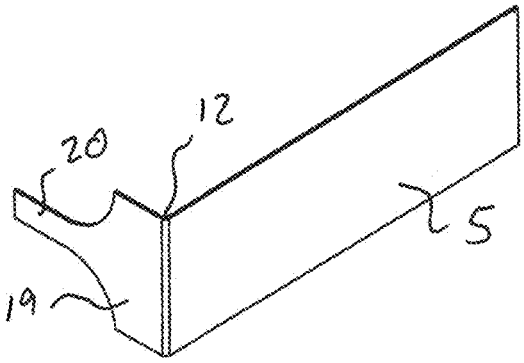
FIG. 7F is an isometric view showing the modified bracket end section used in the second preferred embodiment shown in FIGS. 6 and 7A-7E.
Figure 2F:
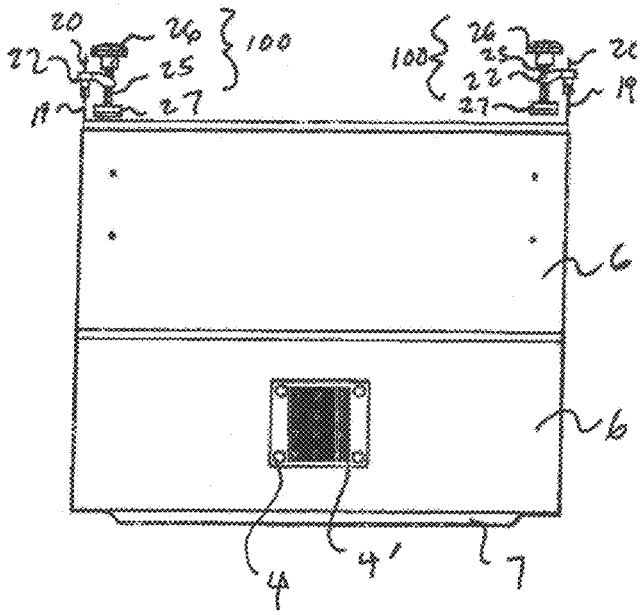
FIG. 2F is a top view of package-protecting delivery receptacle of FIG. 2A.

FIG. 2G shows an example of an input device 4' that includes key pad. However, it will be appreciated that the identification input device may include any means, mechanism, or device for entering an identification code or otherwise identifying the carrier or customer, including a key mechanism, an RFID reader, a WiFi, RF, or infrared controller, a biometric scanner or reader, a camera for facial recognition or remote identification, a barcode reader, or any other access or security control mechanism or device placed anywhere on the container 1. Instead of a lip 7 or other appendage to facilitate opening of the lid 6, the lid 6 may be opened automatically by a motorized or hydraulic mechanism, and the lid 6 itself may be replaced by a sliding or hinged access door at the top or front of the container. The lock 55,55', details of which do not constitute a part of the present invention, may include any container lock that provides adequate security and that can be controlled by the identification input device. Numerous different container locks are currently available or known to those skilled in the art.

Figure 4D:
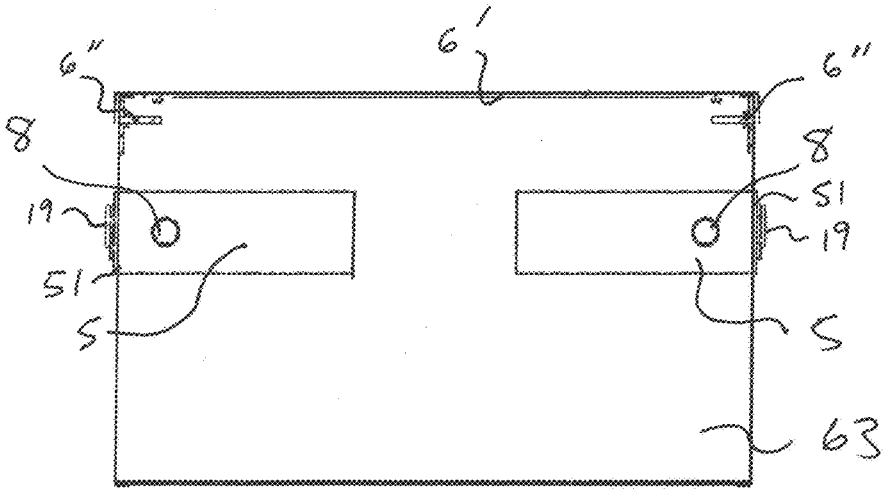
FIG. 4D is a front view of the rear panel for the package-protecting deliver receptacle shown in FIG. 4A.
Figure 3:
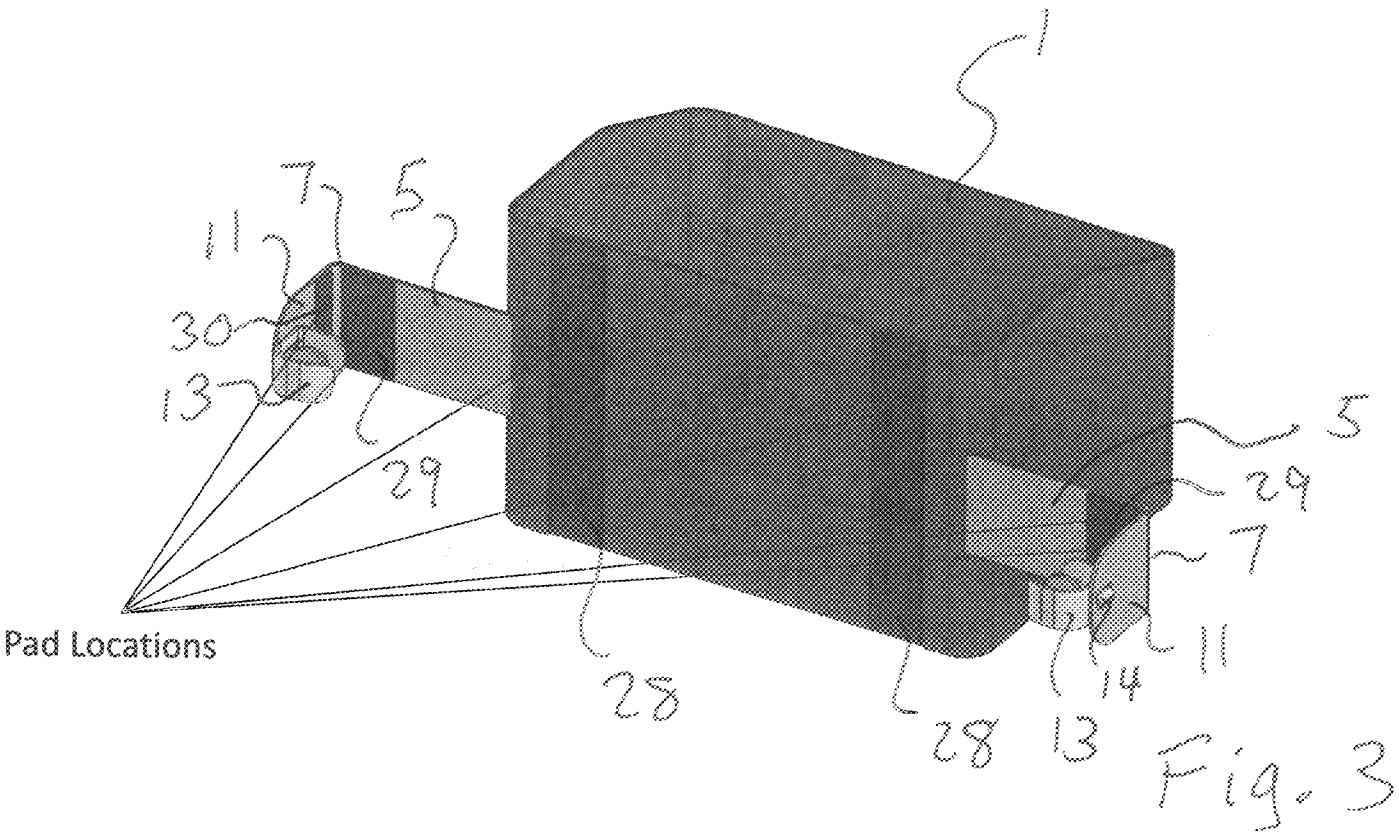
FIG. 3 is an isometric view, taken from the rear, of a package-protecting delivery receptacle to which an attachment bracket or belt has been secured according to a first preferred embodiment of the invention.
Figure 4F:
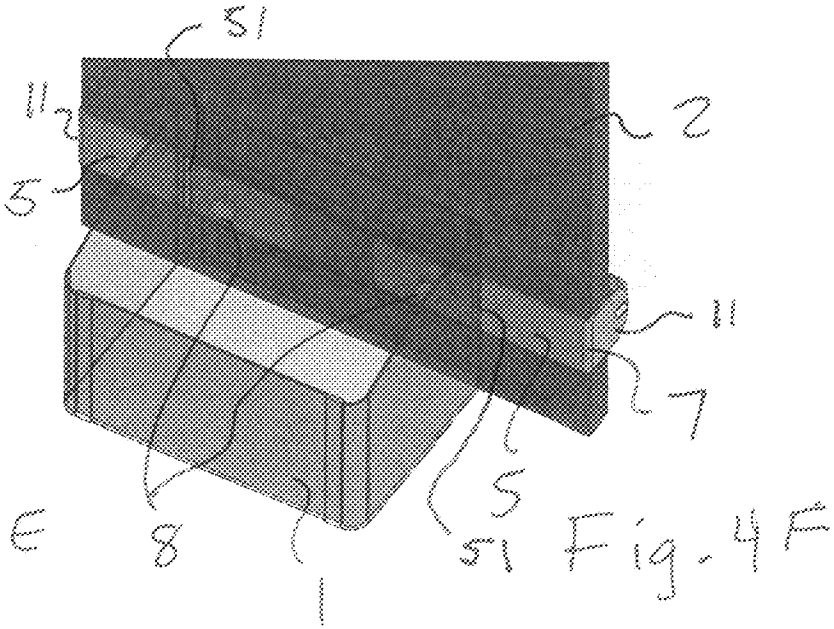
FIG. 4F is an isometric view similar to that of FIG. 4E, with the belt-securing plate of FIGS. 4B and 4C removed to illustrate positioning of the extendable sections of the attachment bracket within the receptacle.
Figure 4E:
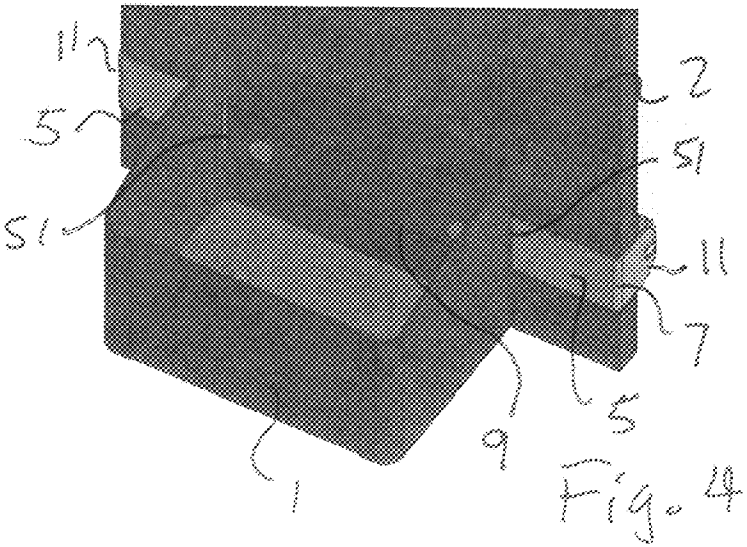
FIG. 4E is an isometric view of the package-protecting delivery receptacle with lid removed, as shown in FIG. 4A, in an installed position.

As shown in FIGS. 3 and 4A-4F, the attachment bracket 3 may include two sheet metal bracket or belt sections 5 that slidably extend from and are retractable into the container 1. The two bracket sections 5 may be a single telescoping unit that is built into the container, or inserted by the customer through slots 51 in the back of the container before attachment of the container to the door 2. Alternatively, the belt sections 5 may be separate pieces that are each extendable from the slots 51 in the rear of the container, as illustrated in FIGS. 4A-4F. The rear of the container includes bracket cover plate 9 attached to the rear panel 63 by flanges 92, and which includes a raised section 91 that forms a passage to permit the bracket sections 5 to be retracted or extended from the box. FIGS. 4D and 4F show the rear of the receptacle 1 with bracket cover plate 9 removed to expose the bracket sections 5, which may be selectively held in a retracted or extended position by knobs 8 accessible from within the receptacle and that include threaded portions that extend through complementary threaded openings 93 in the bracket cover plate 9 to enable the knobs to be contact and release the bracket sections 5 in any desired extended position. Optionally, slots or indents (not shown) may be added to the bracket sections to increase friction when tightened.

Upon extension of the bracket sections 5 to a position in which a bend or crease 6 in the sections is parallel to the side of the door 2, a perpendicularly extending bent or L-shaped section 11 is extended around the side of the door or through the clearance between the door 2 and the door frame (as is necessary on the hinged side of the door). The bent section 11 may be pre-formed at the end of the bracket sections 5, or created by the user by bending the bracket sections at a vertical crease 12 or bending area. The latter option allows the bracket sections 5 to be fully retracted into the receptacle when the bracket has been returned to the unbent position.

In a first preferred clamping mechanism embodiment shown in FIGS. 3 and 5A-5C, slots 12 are provided at the ends of the bent sections 11 to permit attachment of respective clamping mechanisms 13 arranged according to a first preferred embodiment of the invention. On the hinge side of the door 2, the clamping mechanism must be attached after the end of the bent sections has been passed or threaded through the corresponding clearance space between the door 2 and the frame, while the order of bent section positioning and bracket attachment is not critical for the opposite side of the door 2. The clamping mechanisms 13 each have a C-shaped construction that includes a main body consisting of a tab section 14 and arms 15 and 16 extending in an approximately transverse direction therefrom, with a bent tab 14 extending from a tab section 14 for securing the clamping mechanism to the belt by extending through a respective slot 12. It will be appreciated by those skilled in the art that the tab and slot may be replaced by other joining arrangements, including clips or other fasteners, interference fit pins or rivets, screws or any other arrangements or mechanisms that permit the respective clamping mechanisms to be removably attached to the bent bracket sections 11. Once the bent sections 11 are positioned and the clamping mechanisms 13 attached, the knobs 10 in the receptacle, if provided, may be tightened to lock the bracket sections 5 in position, at which time the clamping mechanisms 13 may be secured to the door 2.

Securing of the clamping mechanisms 13 to the door 2 is accomplished by a clamping knob 17. Clamping knob 17 includes a rotary member 18 from which a threaded rod 18 extends, the threaded rod 18 passing through and engaging a threaded opening in the clamping mechanism arm 15 to a padded member 19 that pressed against the rear of door 2 upon turning, by the installer, of the rotary member 18. The padded member 19 may be made of a plastic material or provided with a soft pad so as to prevent damage to the door when the knob 17 is tightened to secure the corresponding bracket section 5 in position. Aside from the pad or padded member 19 and the rotary member 18, the clamping mechanism may be made of sheet metal.

An alternative to the clamping mechanisms 13 shown in FIGS. 3 and 5A-5C is the alternative clamping arrangement shown in FIGS. 6 and 7A-7E. In this alternative, the slotted ends of the bent bracket sections 11 shown in FIGS. 3 and 5A-5C are replaced by tapered bent sections 19, each of which terminates in a tongue 20. and the C-shaped clamping mechanisms 13 are each replaced by sliding and clamping mechanisms 21, each including a sliding piece 22, which may be made of a plastic material, and which fits over the tongue 20 when the tongue 20 is passed through a slot 23 and locked in placed by a latch 24 that includes a flexible tongue-engaging member 30. Tongue-engaging member 30 holds the sliding piece 22 in place on the tongue by, for example, friction or engagement between tongue-engaging member 30 and the tongue 20, an overcenter mechanism, a releasable ratchet, or any other means of preventing relative movement between the sliding piece 22 and the tongue 20. Like the clamping mechanisms 13, each sliding piece 22 of this exemplary embodiment includes a threaded bore through which a correspondingly threaded rod 25 is passed, the treaded rod including a rotating piece 26 and a padded door-engaging member 27 that is pressed against the door 2 when the rotating member or piece 26 is rotated, thereby locking the bracket sections 5 in place to secure the container 1 to the door 2, as shown in FIG. 1. Rotating member or piece 26 and padded member 27 may have the same construction and materials as the rotating member 18 and padded member 19, while the remaining pieces of the clamping mechanism may be made of sheet metal. Because the door holding mechanism of this embodiment is slidable, it can more easily accommodate a wider range of door thicknesses.

Figure 6:
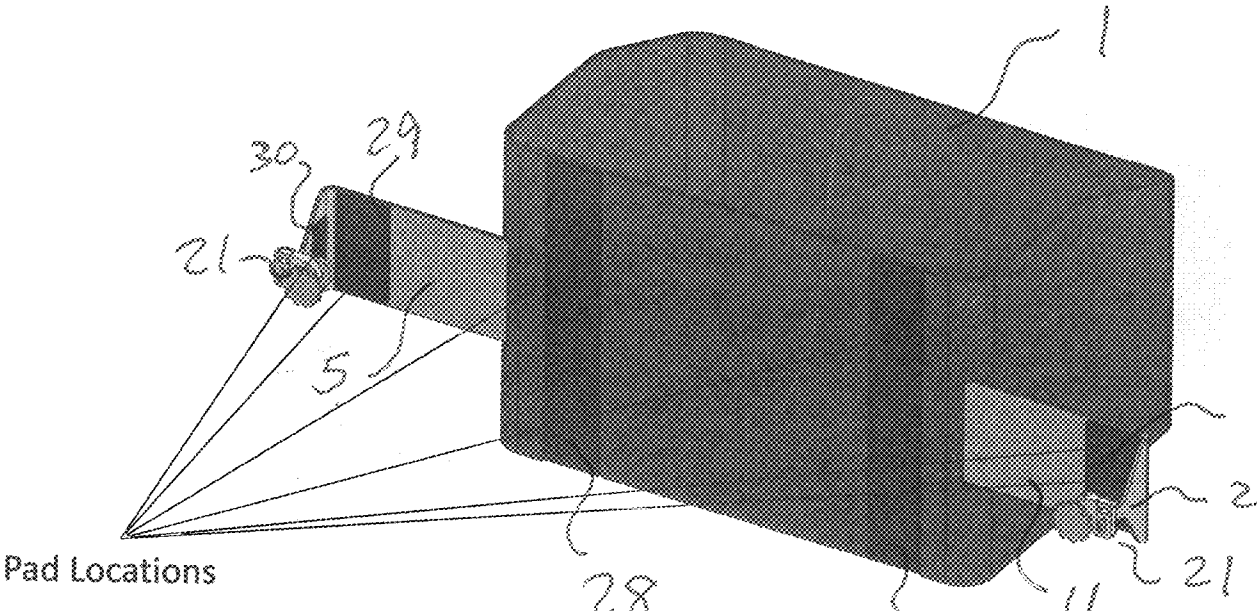
FIG. 6 is an isometric view taken from the rear, of a package-protecting delivery receptacle and attachment bracket according to a second preferred embodiment of the invention.
Figure 7C:
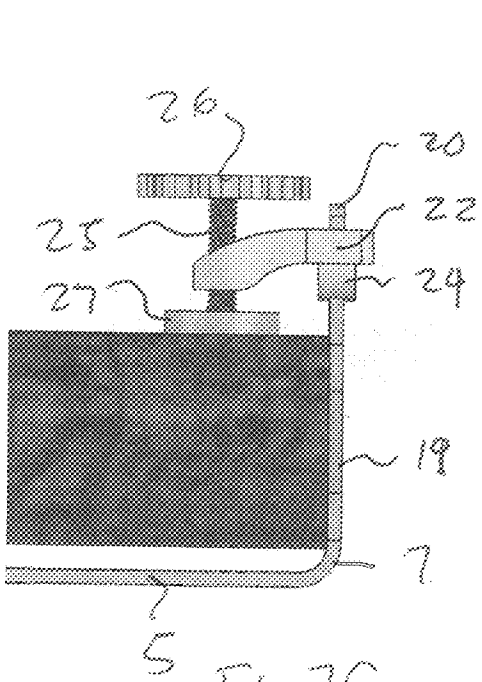
FIG. 7C is a top view of the clamp and sliding mechanism of FIGS. 6A and 6B.
Figure 7B:
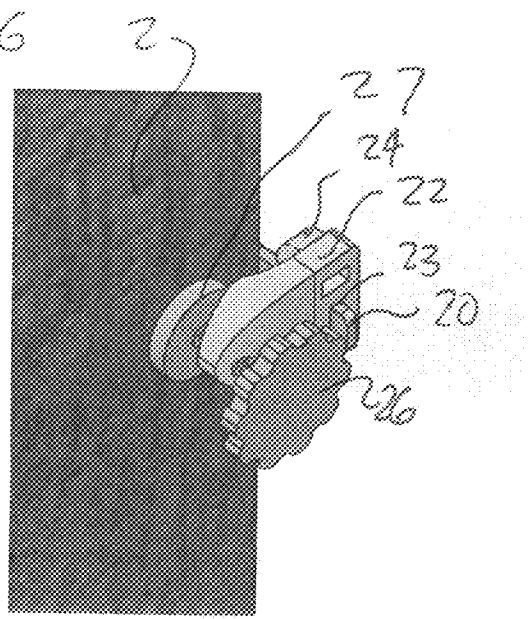
FIG. 7B is a second isometric view of the clamp and sliding mechanism of FIG. 6A.
Figure 7A:
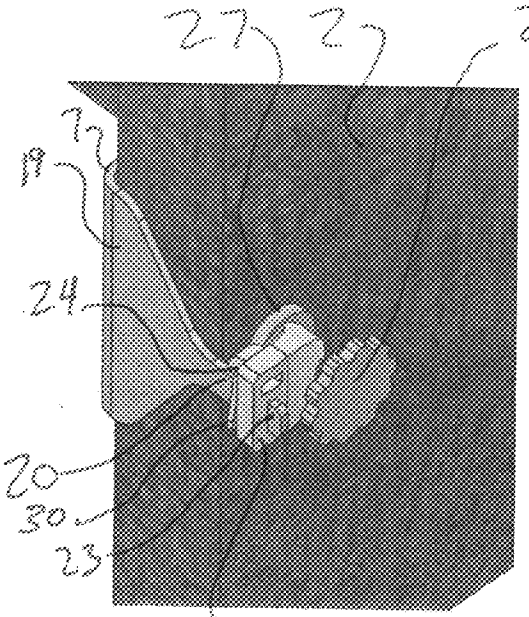
FIG. 7A is an isometric view showing details of a clamp and sliding mechanism for the attachment bracket illustrated in FIG. 5.

The preferred embodiments of the invention shown in FIGS. 3 and 6 may also be provided with additional protection for the door 2, in the form for example of pads 28 on the rear of the receptacle 1, pads 29 on the laterally extending bracket sections 5, and/or pads 30 on the rearwardly extending bent sections 11.

It will be appreciated that the different clamping mechanisms described above are illustrated by way of example, and that their construction may be varied without departing from the scope of the invention, as may details of the bracket sections and the receptacle itself, as noted above.

A preferred method of installing a package-protecting receptacle as illustrated herein involves extending the bracket sections 5 so that the bent sections 11 or 19 can be extended around sides of the door, attaching clamping mechanisms 13 or 21 to the bent sections 11 and 19, rotating the rotating members or pieces 18 or 26 to press the door-engaging padded members 19 or 27 against the door, optionally securing the brackets via knobs 10, and closing the lid of the receptacle, which is automatically or manually locked upon closure. The receptacle is moved after retrieval of a delivered package from the receptacle by reversing the installation steps.

What is claimed is:

1. A package-protecting delivery box, comprising:

a locking receptacle for receiving a delivered package; and a bracket structure including bracket sections that slidably extend laterally on two sides of the receptacle and around two horizontally-opposed front and rear sides of a door; and clamping mechanisms removably attachable to the respective bracket sections for securing ends of the bracket sections to the rear side of the door when the locking receptacle is positioned at the front side of the door.

2. A package-protecting delivery box as claimed in claim 1, wherein the bracket sections are made of sheet metal members that extend independently from slots in the receptacle.

3. A package-protecting delivery box as claimed in claim 2, wherein each clamping mechanism includes a rotatable knob including a pad that engages the rear of the door to clamp the respective bracket section against the door.

4. A package-protecting delivery box as claimed in claim 3, wherein the knob includes a threaded rod extending through an arm of a main body of the clamping mechanism.

5. A package-protecting delivery box as claimed in claim 4, wherein the main body of the clamping mechanism is made of sheet metal and the pad is made of a soft material that prevents damage to the door.

6. A package-protecting delivery box as claimed in claim 2, wherein ends of the bracket sections are slotted to receive tabs extending from the respective clamping mechanisms to thereby removably secure the clamping sections to the bracket sections.

7. A package-protecting delivery box as claimed in claim 2, wherein ends of the bracket sections are tapered to form tongues that fit into slots in a slider of the respective clamping mechanism to adjustably secure the clamping mechanisms to the bracket section.

8. A package-protecting delivery box as claimed in claim 2, wherein ends of the bracket sections include creases to enable bending of the bracket sections that form rearwardly extending bent sections.

9. A package-protecting delivery box as claimed in claim 1, further comprising knobs in the receptacle for fixing positions of the bracket sections when extended.

10. A package-protecting delivery box as claimed in claim 1, further comprising padding on the receptacle and bracket sections for preventing damage to the door.

11. A package-protecting delivery box as claimed in claim 1, wherein the bracket sections are sheet metal belt structures that slidably extend laterally from the two sides of the receptacle and around the two sides of the door, and in which the clamping mechanisms secure the belt structures to the door by means of respective rotating knobs.

12. A package-protecting delivery box as claimed in claim 11, wherein positions at which the clamping mechanisms are attached to the ends of the sheet metal belt structure are adjustable by a slider mechanism.

13. A package-protecting delivery box as claimed in claim 1, wherein the clamping mechanisms each includes a rotatable clamping knob with a rubber or soft plastic contact surface that engages the rear side of the door when the receptacle is positioned at the front side of the door.

14. A package-protecting delivery box as claimed in claim 1, wherein the receptacle includes a hinged lid and locking mechanism operable by a code entered via a keypad or RFID transceiver.

15. A package-protecting delivery box as claimed in claim 1, wherein the receptacle is a secure, tamper proof metal/industrial fabric case with an angled lid and secure lock.

16. A package-protecting delivery box as claimed in claim 1, wherein the receptacle further includes at least one thermal compartment for food deliveries.

* * * * *